United States Patent [19]

Nishizawa et al.

[11] Patent Number: 4,909,994

[45] Date of Patent: Mar. 20, 1990

[54] CATALYTIC CONVERTER

[75] Inventors: Kimiyoshi Nishizawa; Hajime Kawasaki, both of Yokohama, Japan

[73] Assignee: Nissan Motor Co., Ltd., Japan

[21] Appl. No.: 216,645

[22] Filed: Jul. 8, 1988

[30] Foreign Application Priority Data

Jul. 10, 1987 [JP] Japan ..... 62-105268[U]

[51] Int. Cl.[4] ..... F01N 3/15

[52] U.S. Cl. ..... 422/180; 422/190; 422/211; 422/221; 422/222; 422/179

[58] Field of Search ..... 422/171, 177, 179, 180, 422/190, 211, 221, 222

[56] References Cited

U.S. PATENT DOCUMENTS

| | | | |
|---|---|---|---|
| 3,780,772 | 12/1973 | Carnanhan et al. | 422/177 X |
| 4,115,071 | 9/1978 | Masuda et al. | 422/179 |
| 4,143,117 | 3/1979 | Gaysert | 422/179 |
| 4,161,509 | 7/1979 | Nowak | 422/179 |
| 4,186,172 | 1/1980 | Scholz | 422/180 |
| 4,203,949 | 5/1980 | Mase et al. | 422/179 |
| 4,282,186 | 8/1981 | Nonnenmann et al. | 422/180 |
| 4,444,721 | 4/1984 | Ohkata | 422/180 X |

FOREIGN PATENT DOCUMENTS 54-13462 1/1979 Japan .

*Primary Examiner*—Barry S. Richman
*Assistant Examiner*—Lynn M. Kummert
*Attorney, Agent, or Firm*—Lowe, Price, LeBlanc, Becker & Shur

[57] ABSTRACT

A catalytic element is encased in a shell in such a way as to be held tightly between shell halves but not fixed to same. A pair of stoppers for preventing endwise movement of the catalytic element is provided to the shell. A predetermined clearance is provided between each of the stoppers and each end of the catalytic element so as to allow such movement of the catalytic element relative to the shell that results from a thermal expansion differential between the catalytic element and the shell.

16 Claims, 9 Drawing Sheets

CATALYTIC CONVERTER

BACKGROUND OF THE INVENTION

1. Field of the Invention

The present invention relates to a catalytic converter for purification of exhaust gas emitted from an automotive engine.

2. Description of the Prior Art

An example of a catalytic converter of this kind is disclosed by Japanese Provisional Patent Publication No. 54-13462 and also shown in FIGS. 7A to 7E.

Referring to FIGS. 7A to 7E, the catalytic converter consists of a flat thin sheet of metal 1 (FIG. 7D) and a corrugated thin sheet of metal 2 overlapping each other and wound into a spiral shape to form a honeycomb-like body. The honeycomb-like body is inserted into a shell 3, and thereafter the sheets 1 and 2 and the shell 3 are soldered together to constitute a monolithic catalytic element which is then coated with a precious metal serving as a catalyst.

The shell 3 of the catalytic element is welded at opposite ends to diffusers 4 and 4 welded to flanges 5 and 5 for attachment to exhaust pipes (not shown), respectively.

In use, the shell 3 is subjected to atmospheric cooling and therefore maintained at a relatively low temperature (about 400° C.) whilst on the contrary the honeycomb monolith 6 constituted by the flat and corrugated sheets 1 and 2 is heated up to a high temperature (about 800° C.) by the hot exhaust gases passing therethrough and further by the heat generated by the catalyst covering the outer surface thereof. Due to this, a thermal expansion differential is caused between the shell 3 and the honeycomb monolith 6, and as shown in FIG. 7(E) the honeycomb monolith 6 is expanded or extended relative to the shell 3 in the longitudinal direction of the passages through which the exhaust gases flow, causing a problem that the soldered joint between the shell 3 and the honeycomb monolith 6 is broken to allow both to be separated from each other and cause play, rattling sounds and, in the worst case, breakage thereof.

SUMMARY OF THE INVENTION

In accordance with the present invention, there is provided an improved catalytic element which comprises a catalytic element formed from a flat thin sheet of metal and a corrugated thin sheet of metal juxtaposed upon each other, wound into a spiral shape and coated with a catalyst, a metal shell encasing the catalytic element and forced to contact at at least part of an inner circumferential surface thereof an outer circumferential surface of the catalytic element to hold same tightly therein, and stopper means for stopping endwise movement of the catalytic element, provided to the shell in such a way that a predetermined clearance is provided between each end of the catalytic element and the stopper means.

The above structure is effective for overcoming the above noted disadvantages inherent in the prior art device.

It is accordingly an object of the present invention to provide an improved catalytic converter which is free from disadvantages caused by a thermal expansion differential between a catalytic element and a shell.

It is another object of the present invention to provide an improved catalytic converter of the above described type which prevents cracks and breakages of the catalytic element.

It is a further object of the present invention to provide an improved catalytic converter of the above described type which can eliminate a soldered joint otherwise necessitated for securing the catalytic element to the shell, thus making it possible to assuredly prevent play of the catalytic element and rattling sounds caused by breakage of the soldered joint.

BRIEF DESCRIPTION OF THE INVENTION

DESCRIPTION OF THE PREFERRED EMBODIMENTS

Figure 1A:
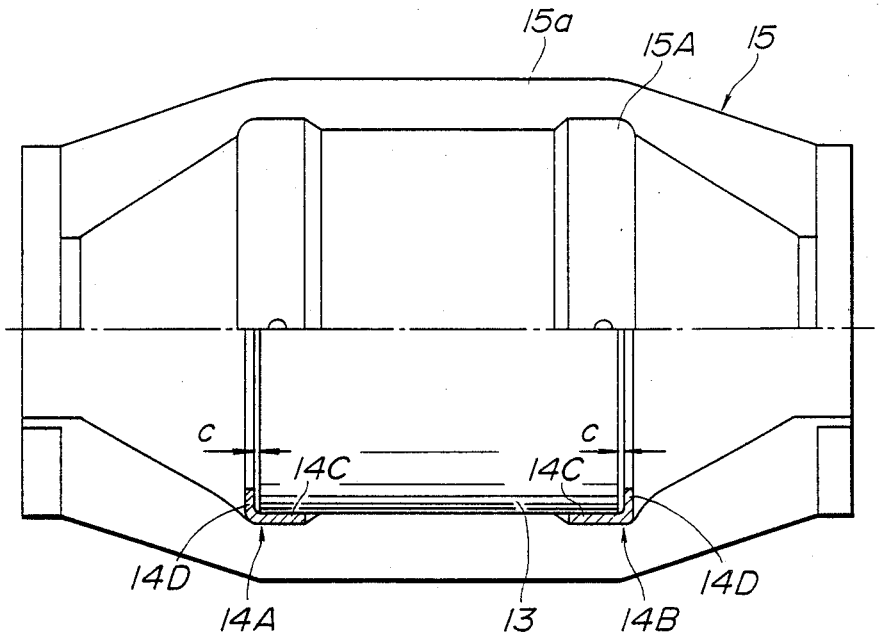
FIG. 1A is a plan view of a catalytic converter according to an embodiment of the present invention, with a lower half depicted in sectional view.
Figure 1B:
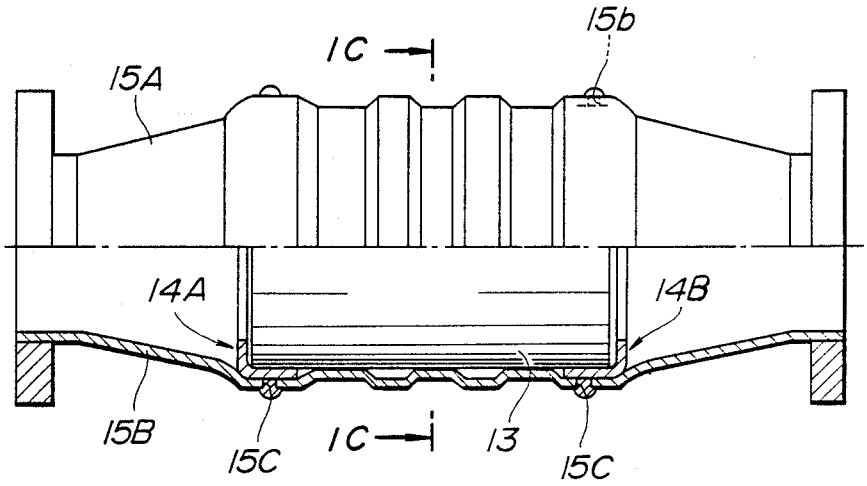
FIG. 1B is a side elevational view of the catalytic converter of FIG. 1A, with a lower half in section.
Figure 1C:
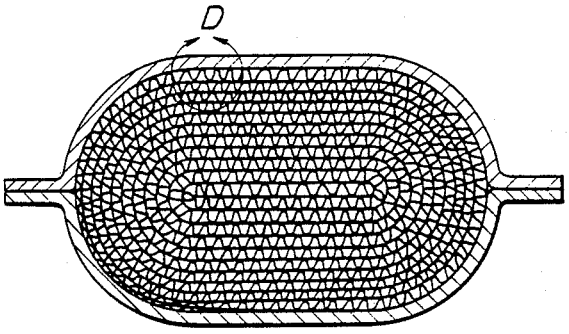
FIG. 1C is a sectional view taken along the line 1C—1C of FIG. 1B.
Figure 1D:
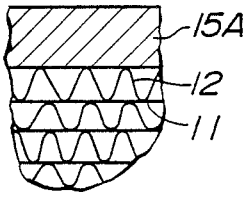
FIG. 1D is an enlarged view of the portion "D" of FIG. 1C.
Figure 1E:
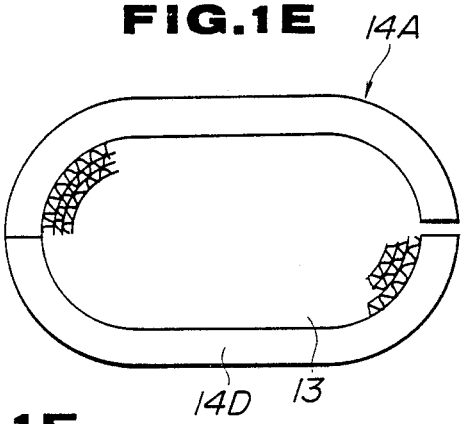
FIG. 1E is a left side view of an important portion of the catalytic converter of FIG. 1A.
Figure 1F:
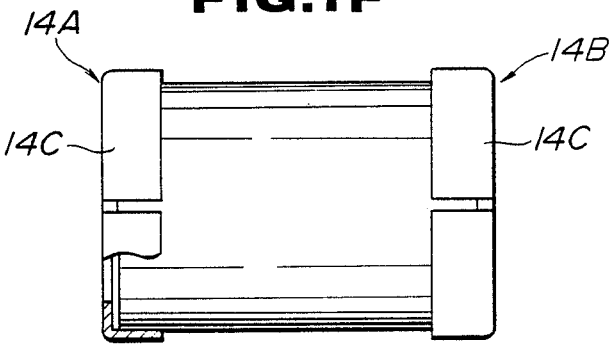
FIG. 1F is an elevational view of the important portion of FIG. 1E.

Referring to FIGS. 1A to 1F, a thin flat sheet of metal 11 and a corrugated thin sheet 12 of metal are laid one upon the other and soldered (e.g., by using a nickel alloy solder) or otherwise welded together. The sheets 11 and 12 thus joined together are wound into a spiral shape and coated with a material serving as a catalyst for thereby constituting a monolithic catalytic element 13 of a uniform ellipse-like cross section having a pair of parallel straight edges which are joined by a pair of semicircular edges.

A pair of annular stoppers 14A and 14B of L-shaped cross section are respectively installed on the opposite ends of the catalytic element 13. Each of the stoppers 14A and 14B is formed from two constituent parts of a C-like configuration which are welded together at one pair of mated ends so as to form a split ring-like configuration. More specifically, each of the stoppers 14A and 14B is so shaped as to have parallel straight portions between the opposite semicircular portions and to have the split portion at one of the semicircular portions. Each of the stoppers 14A and 14B is of an L-shaped cross section having a tubular portion 14C loosely encircling the catalytic element 13 and an inward flange 14D extending inwardly from an outer end of the tubular portion 14C and located in opposition to a corresponding end of the catalytic element 13. The stoppers 14A and 14B are installed on the catalytic element 13 in such a manner that a clearance "c" corresponding in amount to the bending radius with which each of the stoppers 14A and 14B is bent to form the inward flange 14D and the tubular portion 14C is provided between the flange 14D of each of the stoppers 14A and 14B and the corresponding end of the catalytic element 13.

The monolythic catalytic element 13 having installed thereon the stoppers 14A and 14B in the above manner is disposed between shell halves 15A and 15B of which outward flanges **15*a* and 15*a* are welded together to constitute an integral shell 15 so that the catalytic element 13 is tightly held between the shell halves 15A and 15B. The stoppers 14A and 14B are welded to the shell halves 15A and 15B by access holes 15*b* and 15*c* previously formed in the shell halves 15A and 15B**, respectively.

With this arrangement, while the stoppers 14A and 14B are fixed to the shell halves 15A and 15B, and the catalytic element 13 is not fixed to the shell halves 15A and 15B but tightly held therebetween.

In the meantime, each of the stoppers 14A and 14B is welded in two places to the shell halves 15A and 15B, i.e., in one place to the upper shell half 15A and in the other place to the lower shell half 15B. Thereby, the thermal stress resulting from the difference in thermal expansion between the stoppers 14A and 14B and the shell halves 15A and 15B can be reduced sufficiently.

The shell halves 15A and 15B are formed with corrugated portions so that inwardly projected circumferential portions are forced to contact the catalytic element 13 while providing spaces in the places between the projected portions for separating the shell halves 15A and 15B from the catalytic element 13 whereby it becomes possible to control the thermal transmission between the shell 15 and the catalytic element 13 and thereby to hold the catalytic element 13 at a desired temperature which improves both the conversion efficiency and the durability of the catalyst.

In use, when the engine is operated with the catalytic converter of this invention in place in the exhaust passage, noxious substances such as HC, CO and NOx contained in the exhaust gases is transformed into harmless substances to purify the exhaust gases passing through the passages formed by the flat sheet 11 and the corrugated sheet 12 of the catalytic element 13.

In this instance, the catalytic element 13 is heated up to a high temperature of about 800° C. since it is subjected to heating of the exhaust gases of a high temperature and in addition to the heat generated by the catalyst, whilst on the other hand the temperature of the shell haves 15A and 15B is relatively low since the shell halves 15A and 15B are subjected to cooling by the atmosphere.

Due to this, a difference in thermal expansion is caused between the catalytic element 13 and the shell halves 15A and 15B. However, since the catalytic element 13 is not fixed to the shell halves 15A and 15B, the former can move relative to the latter depending on the thermal expansion differential therebetween whilst being held tightly between the latter to avoid any play therebetween.

In the above, it is to be noted that the catalytic converter of this invention does not have any soldered or welded joint to be broken by the thermal expansion differential and therefore any breakage thereof.

It is to be further noted that though the catalytic element 13 can move endwise within the shell 15 when the catalytic converter is continuously vibrated with a certain intensity, such endwise movement of the catalytic element 13 can be maintained below a predetermined amount by the effect of the stoppers 14A and 14B for thereby preventing wear, play and breakage thereof.

It is to be further noted that the amount of exhaust gas that leaks from the catalytic converter, i.e., the amount of exhaust gas flowing through the space between the catalytic element 13 and the shell 15, which space is caused by play otherwise occuring in the prior art device, can be reduced by the present invention, thus making it possible to increase the conversion efficiency.

Figure 2A:
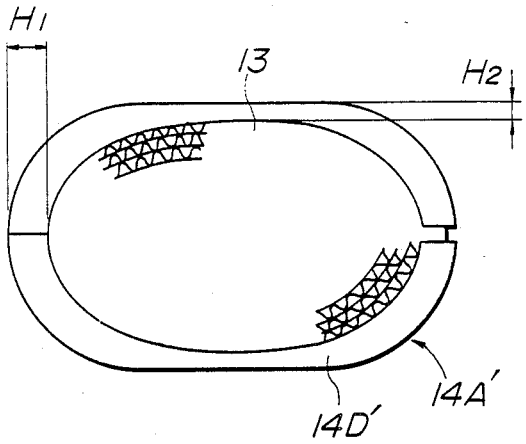
FIGS. 2A and 2B are views similar to FIGS. 1E and 1F but showing another embodiment of the present invention.
Figure 2B:
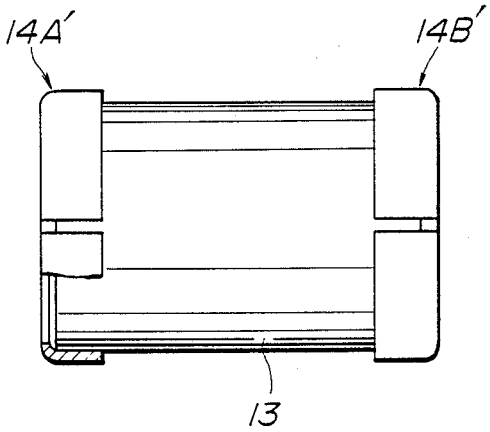

FIGS. 2A and 2B depict another embodiment which is substantially similar to the previous embodiment except that the inward flange 14D' of each of the stoppers 14A' and 14B' is formed so as to be partly smaller in width than the remaining portions, i.e., the width $H_2$ of the parallel straight portions of the inward flange 14D' is smaller than $H_1$ of the semicircular portions. Thus, the area of the catalytic element 13 that is covered by the inward flange 14D' is reduced for thereby increasing the effective area of the catalytic element 13 and therefore the conversion efficiency.

Figure 3A:
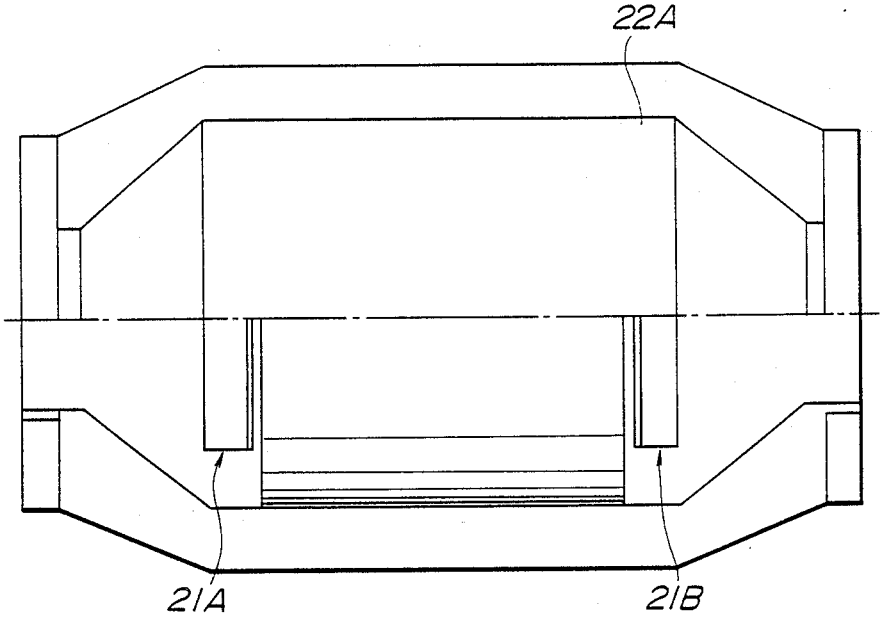
FIGS. 3A and 3B are views similar to FIGS. 1A and 1B but showing a further embodiment of the present invention.
Figure 3B:
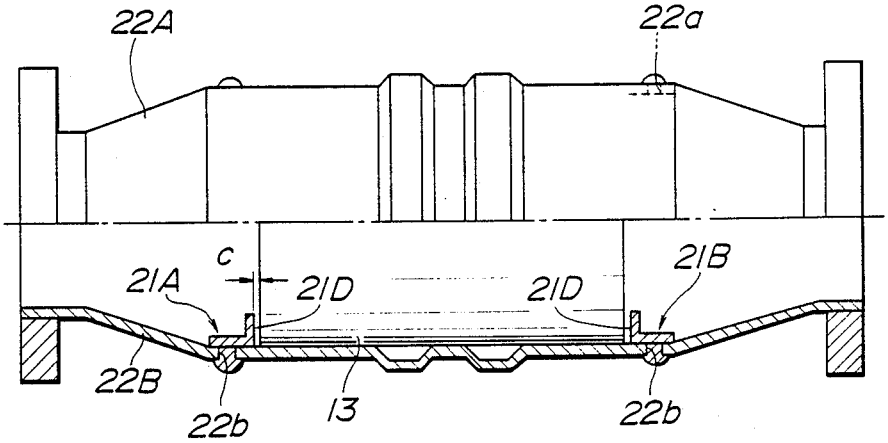

FIGS. 3A and 3B depict a further embodiment which is substantially similar to the previous embodiment of FIGS. 1A to 1F except that a pair of stoppers 21A and 21B of an L-like cross section are not installed on the catalytic element 13 but are arranged adjacent the opposite ends of the catalytic converter 13 in such a way as to have at the inner or nearer ends thereof the inward flanges 21D and 21D, i.e., the stoppers 21A and 21B are directed reversely as compared with the stoppers 14A and 14B of the previous embodiment. The stoppers 21A and 21B are welded to the shell halves 22A and 22B through access holes **22*a* and 22*b* previously formed in the shell halves 22A and 22B**, respectively.

The stoppers 21A and 21B in this embodiment are disposed so that a predetermined clearance "c" is provided between the inward flanges 21D and 21D and the respective ends of the catalytic element 13.

In the previous embodiment of FIGS. 1A to 1F, the end portions of the catalytic element 13 may possibly be deformed when riding on the bent portions between the tubular portion and the inward flange. In this embodiment, such deformation of the catalytic element 13 can be prevented. However, the catalytic element 13 in this embodiment is movable more easily than that of the previous embodiment of FIGS. 1A to 1F since prevention of movement of the catalytic element 13 by the above bent portions can not be obtained. It is therefore necessary in this embodiment to increase the tightness with which the catalytic element 13 is held between the shell halves 22A and 22B.

Figure 4A:
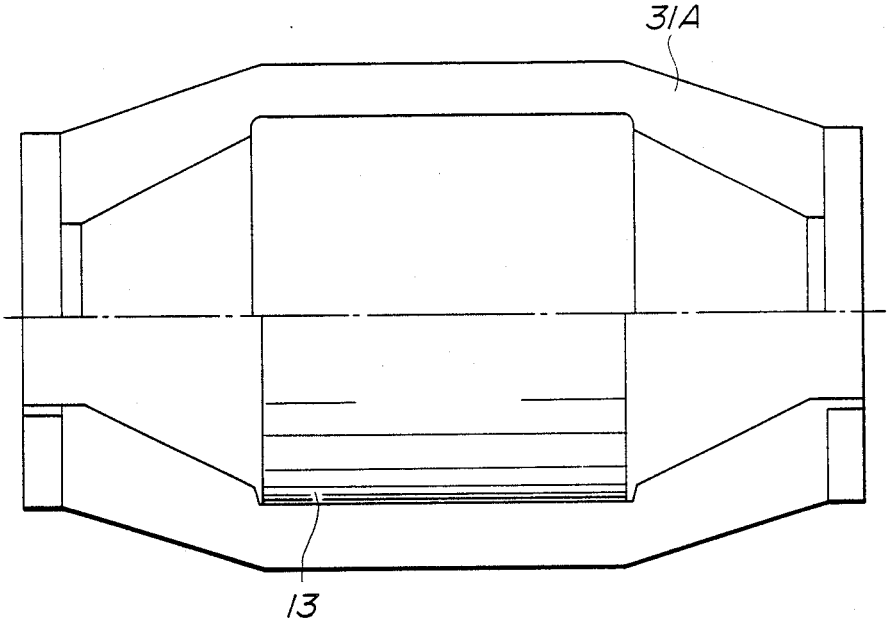
FIGS. 4A and 4B are views similar to FIGS. 1A and 1B but showing a further embodiment of the present invention.
Figure 4B:
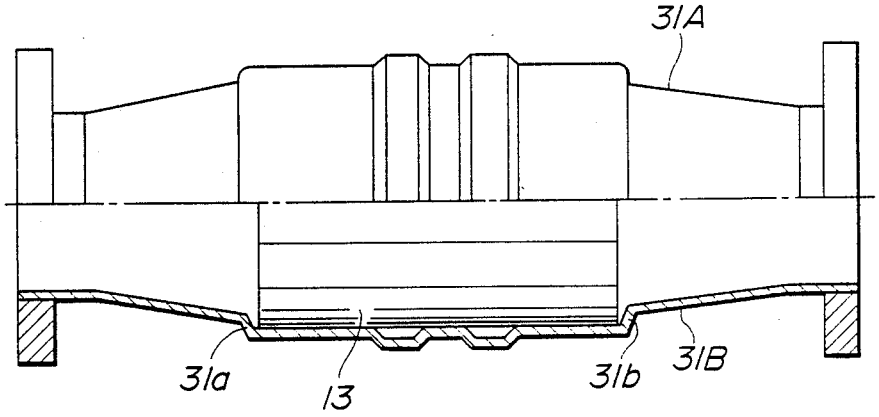

FIGS. 4A and 4B depict a further embodiment which is substantially similar to the previous embodiment of FIGS. 1A to 1F except that stoppers **31*a* and 31*b* are formed integrally with shell halves 31A and 31B, i.e., shell halves 31A and 31B are formed with shoulders 31***a* and 31*b* which serves as stoppers for holding therebetween the catalytic element 13.

This embodiment can eliminate the necessity of the independent stoppers and the welding thereof, thus making it possible to attain a simple structure and reduce manufacturing expense.

Figure 6A:
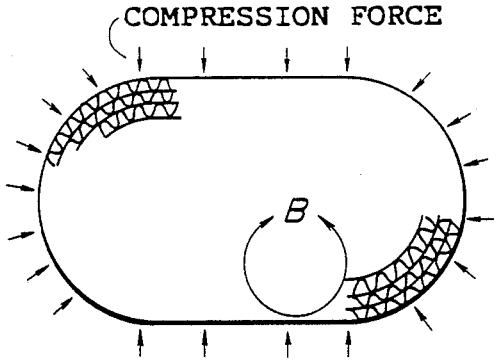
FIG. 6A is a view for illustration of compression forces acting on a catalytic element of a catalytic converter.
Figure 6B:
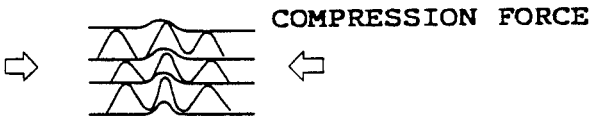
FIG. 6B is an enlarged view of a portion "B" of FIG. 6A.
Figure 7A:
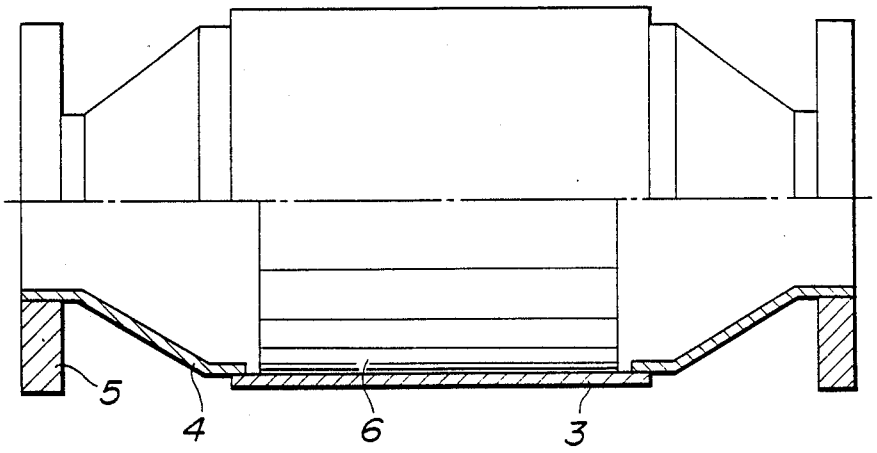
FIG. 7A (PRIOR ART)
FIGS. 7A to 7D are views similar to FIGS. 1A to 1D, respectively but showing a prior art catalytic converter.
Figure 7B:
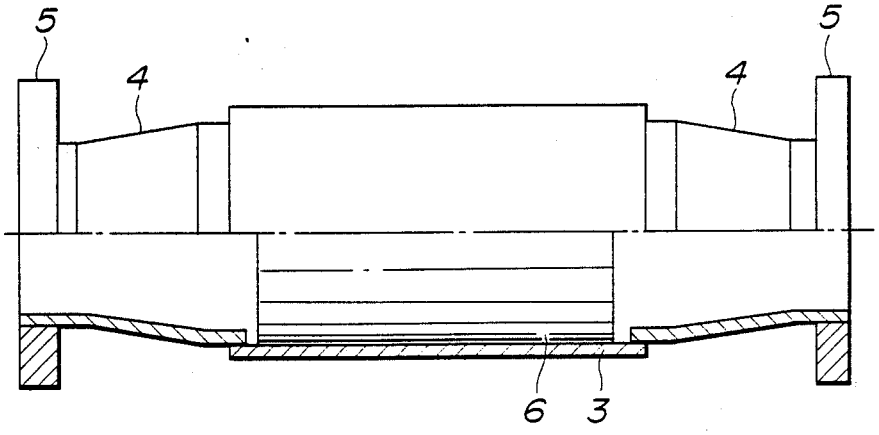
FIG. 7B (PRIOR ART)
Figure 7C:
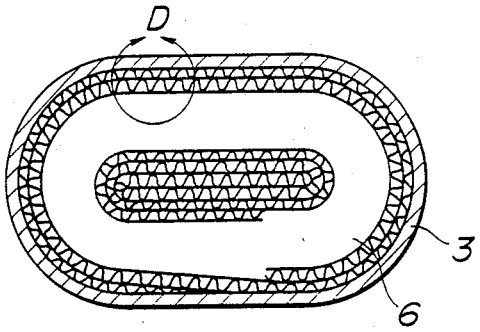
FIG. 7C (PRIOR ART)
Figure 7D:
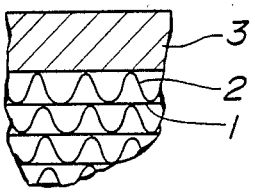
FIG. 7D (PRIOR ART)
Figure 7E:
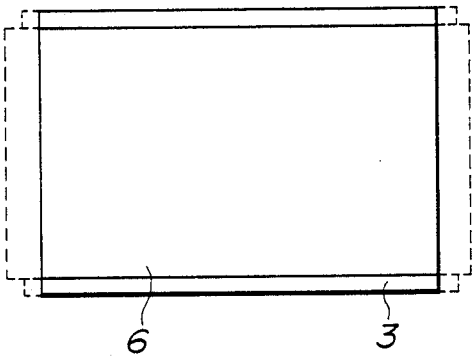
FIG. 7E (PRIOR ART)
FIG. 7E is a view for illustration of a heated condition (dotted line) and a normal temperature condition (solid line) of the catalytic converter of FIG. 7A.

In the meantime, the thermal expansion differential between the catalytic element and the shell is caused not only in the direction of axial flow of the exhaust gases but in the radial direction perpendicular thereto, i.e., toward the circumference of the shell. Due to this, the catalytic converter of the kind in which all the circumferential surface of the catalytic element is forced to contact the inner circumferential surface of the shell has a disadvantage that the catalytic element is subjected to compression forces at the overall circumference as shown in FIG. 6A, causing deformation of the cells of the catalytic element as shown in FIG. 6B which may lead to a possibility of cracks of the sheets forming the catalytic element and breakage of same.

Figure 5A:
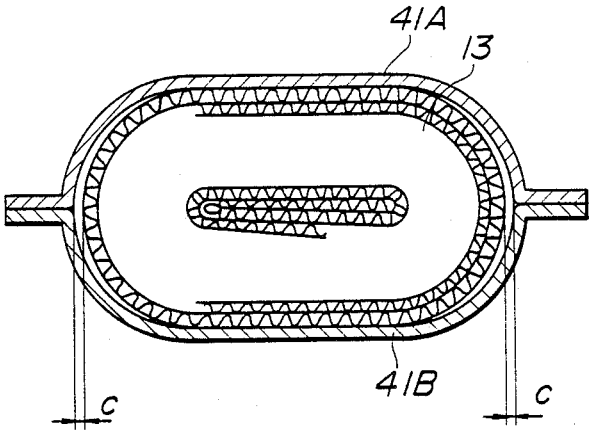
FIG. 5A is a view similar to FIG. 1C but showing a further embodiment of the present invention.
Figure 5B:
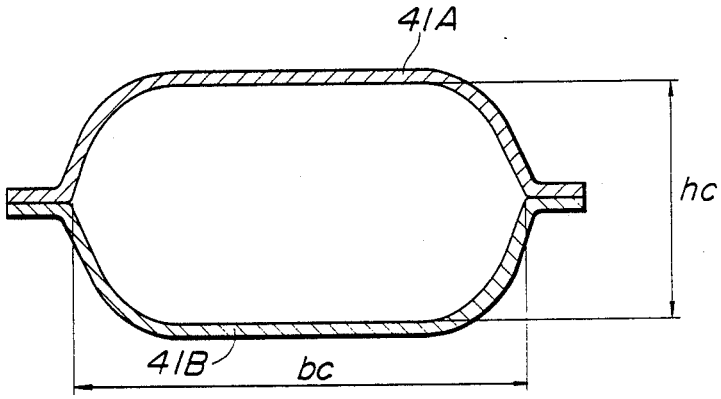
FIG. 5B is a sectional view of a shell employed in the embodiment of FIG. 5A.
Figure 5C:
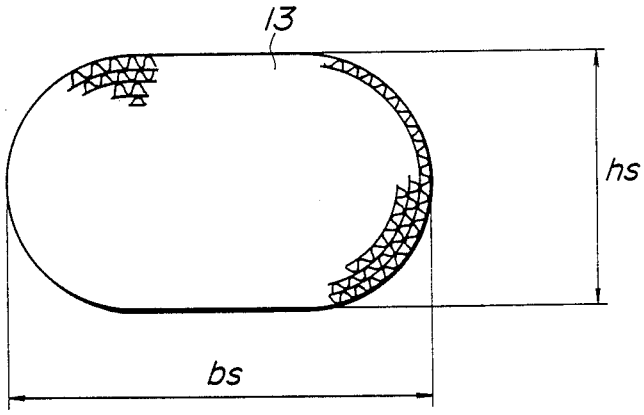
FIG. 5C is a sectional view of a catalytic element employed in the embodiment of FIG. 5A.

FIGS. 5A to 5C depict a further embodiment which is substantially similar to the embodiment of FIGS. 1A to 1F except that while the catalytic element 13 is forced to contact at the upper and lower parallel planar circumferential portions with the shell halves 14A and 14B and thereby held tightly therebetween, a clearance "c" is provided between the semicircular circumferential portions of the catalytic element 13 and the corresponding semicircular circumferential portions of the shell.

More specifically, in order to retain the pressing force with which the catalytic element 13 is held between the shell halves 41A and 41B, the smaller width $h_s$ of the ellipse-like cross section of the catalytic element 13 prior to installation in the shell halves 41A and 41B is larger by 0.5 mm to 2 mm than the width $h_c$ of the ellipse-like cross sectional inner space of the shell halves 41A and 41B, whilst the larger width $b_s$ of the former is so sized with respect to $b_c$ of the latter as to be within the range from $b_c-0.5$ mm to $b_c+1.5$ mm. The compression forces that thus act on the catalytic element 13 in the direction of the above described larger width $b_s$ can be smaller than the compression forces that act on the catalytic element in the direction of the above described smaller width $h_s$, i.e., the catalytic element 13 is held between the shell halves 41A and 41B less tightly in the direction of the larger width $b_s$ than in the direction of the smaller width $h_s$. This is effective for preventing such deformation of cells and cracks of the sheets as shown in FIG. 6B. In this connection, while the clearance "c" between the catalytic element 13 and the shell halves 41A and 41B can be as large as 0.5 mm; the rate of the exhaust gases flowing through the clearance to bypass the catalytic element 13 is sufficiently small so that the noxious substances contained in the overall exhaust gases having passed the catalytic converter is maintained at a harmless level.

In the meantime, the catalytic element 13 has a larger elastic limit with respect to a compression force applied thereto in the direction of the above described smaller width than that with respect to a force applied thereto in the direction of the above described larger width. For this reason, the compression force applied to the catalytic element 13 in the direction of the smaller width thereof may cause deformation of the cells to some extent but not cause such deformation of the cells that leads to cracks and breakages of the sheets forming the cells.

What is claimed is:

1. A catalytic converter comprising:

a catalytic element formed from a substantially flat thin sheet of metal and a corrugated thin sheet of metal positioned one upon the other, wound into a spiral shape and coated with a catalyst;

a metal shell encasing said catalytic element and forced to contact, at at least part of an inner circumferential surface thereof, an outer circumferential surface of said catalytic element for thereby holding the catalytic element tightly therein; and stopper means for stopping endwise movement of said catalytic element, said stopper means being positioned in said shell and spaced from each end of the catalytic element to define a predetermined clearance between each end of said catalytic element and said stopper means.

2. A catalytic converter as set forth in claim 1, wherein said shell is formed from a pair of shell halves which are joined together to hold said catalytic element tightly therebetween.

3. A catalytic converter as set forth in claim 2, wherein said shell halves are formed with corrugated circumferential portions thereof so that inwardly projected circumferential portions are forced to contact the circumferential surface of said catalytic element while providing spaces for separating said shell halves from said catalytic element.

4. A catalytic converter as set forth in claim 2, wherein said stopper means includes a pair of stopper members each being of a generally L-shaped cross section with a tubular portion and an inward flange extending inwardly from an end of said tubular portion to oppose a corresponding end of said catalytic element by providing therebetween said predetermined clearance.

5. A catalytic converter as set forth in claim 4, wherein said tubular portions of said stopper members are so arranged as to have inner ends between which the opposite ends of said catalytic element is located, said inward flanges extending from said inner ends of said tubular portions.

6. A catalytic converter as set forth in claim 4, wherein said tubular portion of each said stopper member encircles a corresponding end portion of said catalytic element.

7. A catalytic converter as set forth in claim 6, wherein each of said tubular portions of said stopper members are welded to said shell.

8. A catalytic converter as set forth in claim 7, wherein each of said stopper members is formed from two constitutent parts of a C-like configuration which are welded together at one pair of mated ends thereof and slightly separated at the other pair of mated ends to form a split ring-like configuration.

9. A catalytic converter as set forth in claim 8, wherein each of said stopper members is so shaped as to have a pair of semicircular stopper portions and a pair of parallel straight stopper portions between said semicircular stopper portions and to have a split portion at one of said semicircular stopper portions.

10. A catalytic converter as set forth in claim 9, wherein said predetermined clearance corresponds in amount to a bending radius with which each of said stopper members is bent to form said tubular portion and said inward flange.

11. A catalytic converter as set forth in claim 10, wherein each of said inward flanges has a pair of straight flange portions and a pair of semicircular flange portions between said straight flange portions, said straight flange portions being smaller in width than said semicircular flange portions.

12. A catalytic converter as set forth in claim 1, wherein said stopper means is integrally formed with said shell and comprises a pair of annular stepped portions each of which includes a tubular portion encircling a corresponding end portion of said catalytic element and a flange extending radially inwardly from said tubular portion in such a way as to oppose a corresponding end of said catalytic element by providing therebetween said predetermined clearance.

13. A catalytic converter as set forth in claim 1, wherein said catalytic element has an ellipse-like uniform cross section having a pair of semicircular edges and a pair of parallel straight edges between said semicircular edges, and said shell has an inner space of an ellipse-like cross section similar to that of said catalytic element, said catalytic element and said shell each having a smaller width between said parallel edges and larger width between said semicircular edges, said catalytic element being held by said shell less tightly in the direction of said larger width than in the direction of said smaller width.

14. The catalytic converter of claim 1, wherein said metal shell contacts the catalytic element along their respective circumferential surfaces without welds therebetween.

15. A catalytic converter as set forth in claim 1, wherein said catalytic element is of an ellipse-like uniform cross section and has a pair of semicircular peripheral surfaces, and said shell has an inner space of an ellipse-like cross section similar to that of said catalytic element and having a pair of semicircular inner surfaces, a clearance being provided between each of said semicircular peripheral surfaces of said catalytic element and each of said semicircular inner surfaces of said shell.

16. A catalytic converter comprises a catalytic element formed from a substantially flat metal sheet and a corrugated metal sheet juxtaposed upon each other and wound into a spiral shape and coated with a catalyst material; a metal shell encasing said catalytic element and contacting, along an inner circumferential surface thereof, an outer circumferential surface of said catalytic element to retain the catalytic element within the shell, contact between the catalytic element and metal shell occurring by pressing engagement and without any welds; and stopper means for limiting longitudinal movement of said catalytic element within the shell, said stopper means including radially inwardly extending flanges formed so as to extend peripherally around the axial ends of the catalytic element with a predetermined clearance between each end face of the catalytic element and each respective flange.

* * * * *